US005791769A

United States Patent [19]

Yang

[11] Patent Number: 5,791,769

[45] Date of Patent: Aug. 11, 1998

[54] HALOGEN LAMPSHADE

[75] Inventor: Roger Yang, Taipei Hsien, Taiwan

[73] Assignee: Be-Yang Industrial Corp., Taipei Hsien, Taiwan

[21] Appl. No.: 762,234

[22] Filed: Dec. 9, 1996

[51] Int. Cl.[6] ..... F21S 1/12; F21V 29/00

[52] U.S. Cl. ..... 362/294; 362/414; 362/351; 362/431

[58] Field of Search ..... 362/285, 373, 362/294, 414, 351, 427, 413, 431, 344

[56] References Cited

U.S. PATENT DOCUMENTS 2,491,448 12/1949 Hillenbrand et al. ..... 362/414

4,337,508 6/1982 Moffatt ..... 362/414

4,595,971 6/1986 Dean ..... 362/373

5,593,225 1/1997 Safyan ..... 362/414

*Primary Examiner*—Thomas M. Sember

*Attorney, Agent, or Firm*—Bacon & Thomas

[57] ABSTRACT

Heat from a halogen bulb is effectively dissipated and glare from the bulb is minimized by a lampshade wherein the bulb is mounted to a stand having opposed portions extending through notches of a reflection plate secured to the open bottom of a lamp shell provided with a lamp cover and a plurality of vent holes formed in the top and side wall of the lamp shell. A bracket secured to the bulb stand and reflection plate permits the lampshade to be mounted to a lamp post.

1 Claim, 4 Drawing Sheets

HALOGEN LAMPSHADE

BACKGROUND OF THE INVENTION

1. Field of the Invention

This invention generally involves the field of technology pertaining to lampshades. More particularly, the invention relates to an improved lampshade for a halogen lamp.

2. Description of the Prior Art

The luminous flux generated by a halogen lamp bulb is intense and harmful to human eyes when subjected to long exposure. Moreover, a halogen bulb generates considerable heat and glare. A conventional lampshade for a halogen lamp is shown in FIG. 1 and comprises a substantially conical structure provided with a plurality of vent holes at its top portion for dissipating heat. Conventional shades may also be flat in shape and made of metallic materials which tend to absorb heat and prevent heat dissipation through the vent holes. Thus, uncontrollable heat accumulation is a problem with conventional halogen lampshades.

SUMMARY OF THE INVENTION

It is an object of the invention to eliminate the short comings of traditional halogen lampshades by providing an improved lampshade which eliminates upward glare from the lamp and prevents intensive heat build up during its use.

This and other objects of the invention are realized by providing a lampshade which includes a substantially trapezoidal conical lamp shell having both a top portion and a sidewall provided with a plurality of vent openings formed therein for dissipating heat. The bottom circumferential edge of the shell is folded inwardly to form a rim for supporting a circular reflection plate having a central raised platform provided with a pair of opposed notches formed therein. A bulb stand provided with a pair of opposed sections and a central connection hole is disposed on the platform with the opposed sections engaged through the notches. A V-shaped bracket has one leg secured to the bulb stand and platform, and the other leg secured to both the platform and a lamp post. A lamp cover is mounted to the bottom of the platform by a plurality of locking plates. This arrangement eliminates upward glare from the bulb, thus reducing the temperature of the lamp by 6 to 10 degrees, and also permits effective dissipation of accumulated heat through the vent holes.

Other objects, features and advantages of the invention will become apparent from the following detailed description of a preferred embodiment thereof when taken in conjunction with the attached drawings.

DETAILED DESCRIPTION OF THE PREFERRED EMBODIMENT

Figure 1:
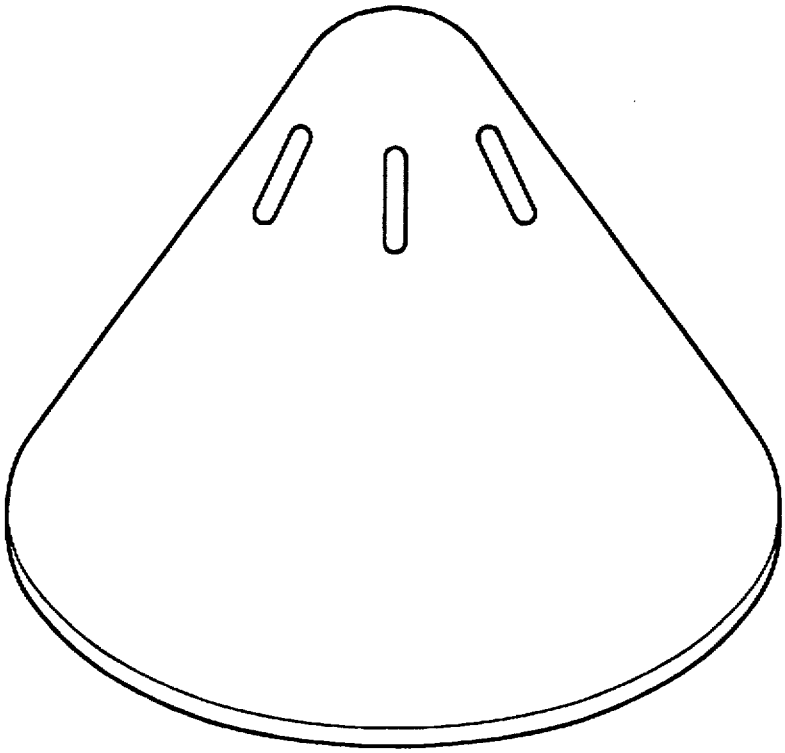
FIG. 1 is a perspective view of a conventional lampshade for a halogen lamp.
Figure 2:
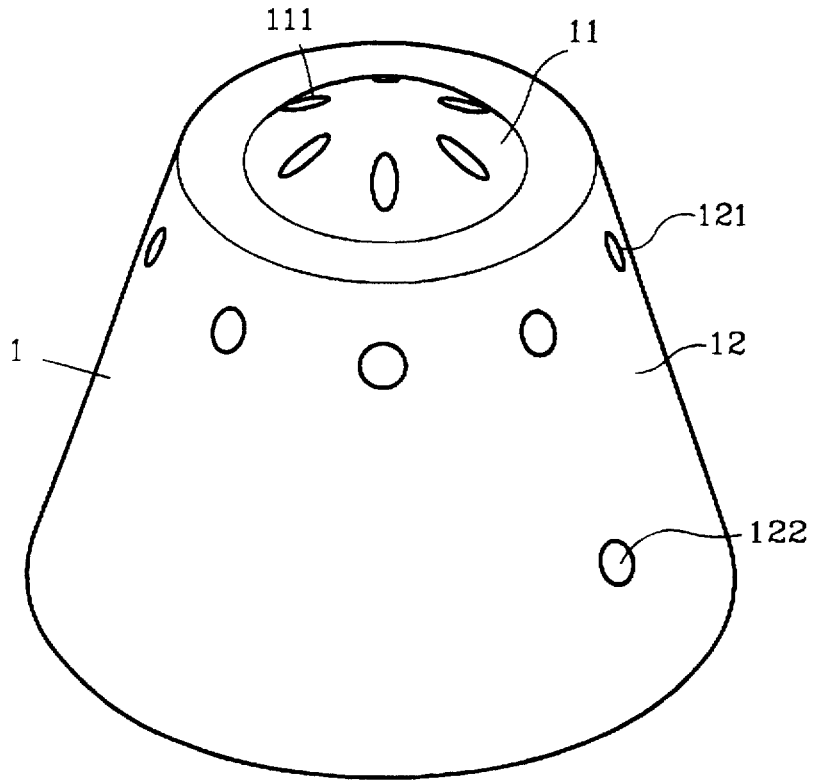
FIG. 2 is a perspective view of the lamp shell forming part of the lampshade of the present invention.

With initial reference to FIG. 2, the lampshade of the present invention includes a lamp shell 1 having a substantially trapezoidal conical configuration and includes a convex top portion 11 provided with a plurality of spaced vent holes 111. Shell 1 also includes a sidewall 12 provided with a plurality of vent holes 121 and a side hole 122.

Figure 3:
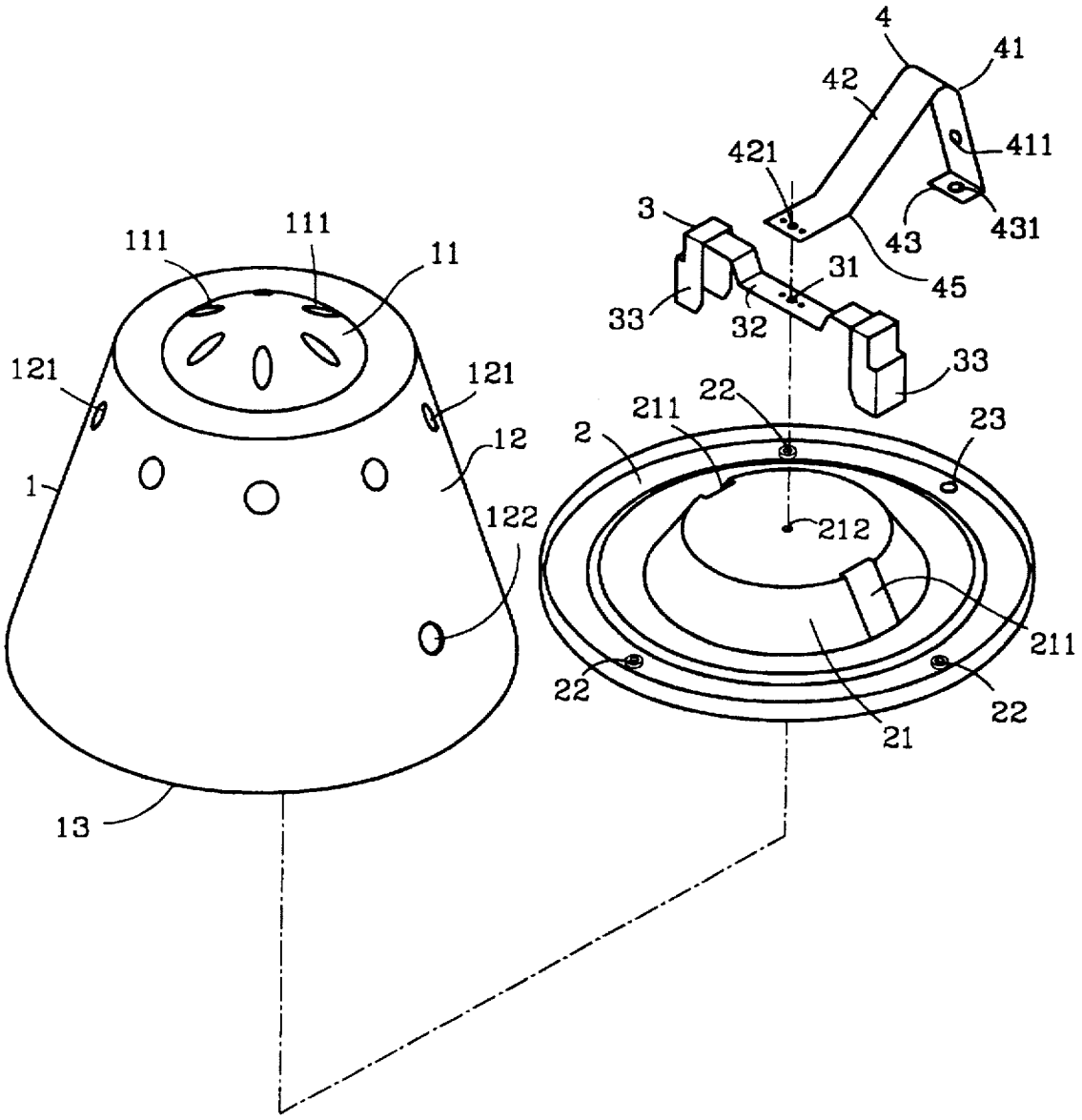
FIG. 3 is an exploded view of the lampshade according to the invention.
Figure 4:
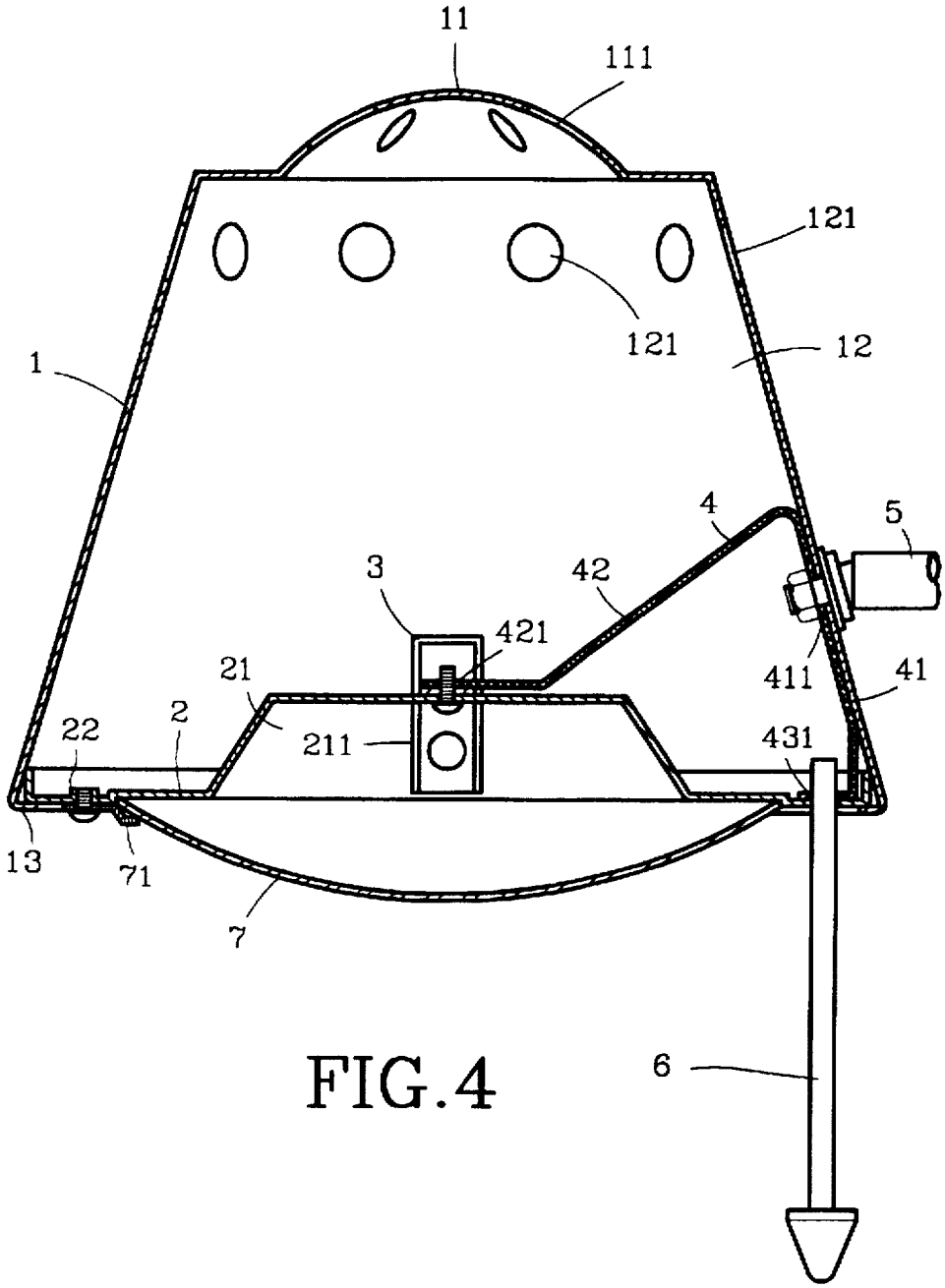
FIG. 4 is a cross-sectional view of a lampshade according to the present invention.

As further shown in FIGS. 3 and 4, the lampshade also includes a circular reflection plate 2, a bulb stand 3 and a bracket 4.

Reflection plate 2 has a raised center platform provided with a central hole 212 and a pair of opposed notches 211 formed therein. A plurality of bolt holes 22 are spaced around the periphery of plate 2 for receiving fasteners, and a bracket hole 23 is also formed in the periphery of plate 2.

Bulb stand 3 includes a connection hole 31 formed in a central portion 32 and a pair of opposed outer portions 33.

Bracket 4 is of a substantially V-shaped configuration defined by a shorter leg 41 and a longer leg 42. Leg 41 is provided with a post hole 411 formed therein and terminates in an outwardly extending flange 43 provided with a bolt hole 431 formed therein. Leg 42 also terminates in an outwardly extending flange 45 having a bolt hole 421 formed therein.

As shown in FIG. 4, reflection plate 2 is secured to a folded rim 13 of lamp shell 1 and a plurality of locking plates are secured by fasteners through bolt holes 22 for mounting a lamp cover 7 to the bottom of plate 2. Opposed portions 33 of bulb stand 3 are disposed through notches 211 of plate 2 so that connection hole 31 is aligned with bracket hole 212. Bolt hole 421 of flange 45 is also aligned with holes 31 and 212 for receiving an appropriate bolt or similar fastener to secure flange 45 and center portion 32 to platform 21. Flange 43 of leg 41 is secured to plate 2 by an appropriate fastener through holes 23 and 431, which also secures the end of a lever 6 for manipulating the lampshade. A lamp post extends through side holes 122 of shell 1 and post hole 411 of leg 41 and is secured therethrough by an appropriate threaded fastener so that leg 41 may be securely attached to shell 1.

Through this arrangement, upward glare from a halogen bulb mounted to bulb stand 3 is prevented by reflection plate 2 and heat from the bulb is effectively dissipated through vent holes 111 and 121 formed in lamp shell 1. The lampshade therefore only emits downward illumination through lamp cover 7 and generates lower heat accumulation then a conventional halogen lampshade. Thus, the improved lampshade structure of the invention has the excellent effects of blocking harmful glare while emitting adequate illumination, and generating less heat than conventional devices of this type.

I claim:

1. A halogen lampshade comprising:

a) a lamp shell having a convex top portion and a sidewall provided with a plurality of vent holes formed therein, the sidewall further including a side hole and terminating in an open bottom;

b) a circular reflection plate mounted to the bottom of lamp shell, the plate including a periphery having a plurality of bolt holes and a bracket hole formed therein, and a center platform having a central hole and a pair of opposed notches formed therein;

c) a bulb stand defined by a central portion provided with a connection hole formed therein and a pair of opposed portions, the opposed portions being disposed through the notches of the platform and the connection hole being disposed in alignment with the central hole of the platform; and d) a bracket of substantially V-shaped configuration defined by a shorter leg and a longer leg, each leg terminating in an outwardly extending flange provided with a bolt hole formed therein, the shorter leg also including a post hole formed therein, the bolt hole of the longer leg being disposed in alignment with the connection hole of the bulb stand and the central hole of the platform for receiving a fastener therethrough, the bolt hole of the shorter leg being disposed in alignment with the bracket hole of the plate for receiving a fastener therethrough and mounting a lever to the plate, and the post hole of the shorter leg being disposed in alignment with the side hole of the lamp shell for receiving a portion of a lamp post therethrough and securing the lampshade to the lamp post.

* * * * *